US007699090B2

(12) United States Patent
Vrielink

(10) Patent No.: US 7,699,090 B2
(45) Date of Patent: Apr. 20, 2010

(54) DRAPERY MASTER CARRIER WITH AUTOMATIC DISENGAGER

(76) Inventor: Gerrit Jan Vrielink, 1700 N. Cheyenne Dr., Richardson, TX (US) 75080

( * ) Notice: Subject to any disclaimer, the term of this patent is extended or adjusted under 35 U.S.C. 154(b) by 374 days.

(21) Appl. No.: 11/761,784

(22) Filed: Jun. 12, 2007

(65) Prior Publication Data

US 2008/0105390 A1 May 8, 2008

Related U.S. Application Data

(60) Provisional application No. 60/864,702, filed on Nov. 7, 2006.

(51) Int. Cl.
*A47H 5/00* (2006.01)

(52) U.S. Cl. ..... 160/345; 16/87.4 R

(58) Field of Classification Search ..... 160/331, 160/345, 346, 347; 16/87.4 R, 87.6 R, 94 D, 16/95 D, 96 D See application file for complete search history.

(56) References Cited

U.S. PATENT DOCUMENTS

| | | | | | |
|---|---|---|---|---|---|
| 2,238,984 | A * | 4/1941 | Richardson | ..... | 160/346 |
| 3,665,550 | A * | 5/1972 | MacFarlane et al. | ..... | 16/93 D |
| 3,736,620 | A * | 6/1973 | Williamson | ..... | 16/87.4 R |
| 3,753,457 | A * | 8/1973 | Bratschi | ..... | 160/331 |
| 3,978,904 | A * | 9/1976 | Riebock et al. | ..... | 160/345 |
| 4,495,671 | A * | 1/1985 | Comeau et al. | ..... | 16/87 R |
| 4,683,935 | A * | 8/1987 | Arquati | ..... | 160/331 |
| 4,881,588 | A | 11/1989 | Madsen | | |
| 6,024,156 | A | 2/2000 | Chu | | |
| 6,637,494 | B1 | 10/2003 | Nabeta | | |
| 6,886,218 | B2 | 5/2005 | ter Braak et al. | | |
| 2003/0221282 | A1 * | 12/2003 | ter Braak | ..... | 16/87.4 R |
| 2006/0162877 | A1 | 7/2006 | Chou | | |
| 2007/0039700 | A1 | 2/2007 | Gu | | |

* cited by examiner

*Primary Examiner*—David Purol
(74) *Attorney, Agent, or Firm*—Carr LLP; Theodore F. Shiells

(57) ABSTRACT

A disengageable master carrier assembly for a motor driven drapery is provided, having a master carrier block section and a locking block section. The locking block section has entrance ramps and a detent pocket sized to receive an engagement member mounted to the master carrier block section. The master carrier block assembly has a support arm for supporting a leading edge of drapery fabric, the support arm being supported by a first resilient member. The engagement member is sized for fitting into the detent pocket of the locking block member and is resiliently urged by a second resilient member disposed between a movable portion of the support arm and the engagement member such that the engagement member will be displaced into its engaged position in the detent pocket when the engagement member is aligned with the detent pocket and will be moved to its disengaged position when the support arm is moved to its disengaged position.

4 Claims, 4 Drawing Sheets

DRAPERY MASTER CARRIER WITH AUTOMATIC DISENGAGER

CROSS-REFERENCE TO RELATED APPLICATIONS

This application relates to, and claims the benefit of the filing date of, U.S. provisional patent application Ser. No. 60/864,702 entitled "DRAPERY MASTER CARRIER WITH AUTOMATIC DISENGAGER," filed Nov. 7, 2006, the entire contents of which are incorporated herein by reference for all purposes.

FIELD OF THE INVENTION

The present invention relates to master carriers that pull traversing motorized drapery systems, specifically to the ability to disconnect a master carrier drive mechanism from the carrier train that supports the drapery or curtain fabrics or materials.

BACKGROUND

Drapery support systems that permit opening and closing of the draperies are well known. Such systems commonly consist of an aluminum, steel or plastic headrail that contains a series of roller or sliding carriers. These carriers have drapery fabric or material connected to them by some form of a drapery hook or other means. Depending on the form of pleating, these carriers are spaced at approximately three inches. Also depending on the pleating system the individual carriers may or may not be not directly connected to each other. In the most common form they are indirectly connected by means of the suspended drapery fabric. A lead carrier or master carrier is normally connected to the foremost end of the drapery fabric.

The master carrier is most commonly attached to a drive cord that is guided inside the metal or aluminum headrail, between the side walls of the headrail. At each end of the headrail, the drive cord is normally guided through a free-wheel pulley at the non-drive end and through a drive pulley at the drive end. In its most common manually operable form, the drive cord is guided down vertically at the drive end where it loops down. By pulling one end of the looped down cord the drapery will be closed, by pulling the other end the drapery will be opened. Some drapery systems do not have a drive cord, but are operated by pulling a wand that is connected to the drive carrier. Instead of being actuated by a cord, some systems are driven by a steel wire or a belt.

Drapery systems may consist of one panel which opens towards one end only (one-way opening), or they may consist of two panels which then close towards the center and open by pulling the panels each to one end (center opening). In the case of very long windows, more than two panels may be hung from the same headrail, for simultaneous opening with a single drive motor.

To avoid excessive wear and tear of drapery fabrics, it is generally not recommended to open and close drapery panels by pulling on the drapery fabrics or materials themselves. Especially on cord actuated systems, the required force to pull a drapery open or close by means of pulling the fabric instead of the cord may require considerable force and result in damage to the fabric or the system.

Motor powered drapery systems are known in either a direct drive version or an indirect drive version. In a direct drive version, the motor is directly connected to the headrail and the rotation power is transmitted to the drive cord or belt via a gear mechanism. An indirect drive version includes cord-drive motors that are normally mounted at some distance below the drapery headrail and have a vertical loop of the drive cord that extends below the headrail, guided through a pulley attached to the motor. Cord drive motors are usually hard to conceal, tend to require more maintenance for cord adjustments, and are usually less powerful than direct drive motors. Cord drive motors are more commonly used to retrofit manual cord driven drapery systems.

Direct drive drapery motors are normally outfitted with a pulley or sprocket that provides traction to rotate the drive cord, belt or wire. The master carrier of the drapery system is normally attached to the drive belt, cord or wire by means of a fixed connection.

Because direct drive motors are normally fully concealed behind the drapery fabric it is often not apparent to a user that a drapery system is motorized. An unsuspecting user may be tempted to start pulling on the fabric to open or close a drape which will require rotation of the motor. However, since such rotation is prevented by the direct drive connection, this could create damage to the mechanism or fabric if excessive force were applied by the user.

To prevent such damage from occurring by inadvertent manual operation by a user, it is necessary to have a method or mechanism to permit easy manual movement of the drapery fabric without damage to the electric drive system, such as by means of a disconnect between motor and drive cord, belt or wire when there is no current applied to the motor. There are currently two methods to achieve this: the electro magnetic shaft disconnect and the overlap master disconnect.

The electromagnetic shaft disconnect consists of a motor shaft that connects the drive shaft of the direct drive motor with a cord drive pulley. By applying power to the motor, magnets in the electromagnetic disconnect get actuated and pull the shaft end into a matching opening of the drive pulley, thus establishing a fixed connection between motor and drive wire. The disadvantage of this system is that it is most commonly operated by drive motors that are started and stopped by means of current sensing. They require considerable torque surges and as a consequence tend to be noisy.

Prior art disconnecting devices exist most commonly in two versions. The first version consists of a spring loaded nipple attached to the traveling master carrier which matches with a depression in a connector block mounted against the inside of a perforated drive belt. Because of space considerations, the microdimensions make the system extremely sensitive to wear and permit only very light drapery weight loads.

The other commonly known version consists of a master carrier featuring a single levered arm provided with one single multipurpose spring. By pulling the far end of the drapery downward, the levered arm frees the locking pin from the portion of the master carrier that is connected to the drive belt. This way the drapery fabric can be moved by hand.

The disadvantage of this system is that there is only one spring to handle both the drapery load function and the locking spring function. This requires that the spring action be strong enough to carry the drapery load, keep it in position and pull the arm back into position, but not so strong that it would prevent the locking pin from sliding back into its connector. The use of a single spring for this dual purpose severely limits the maximum allowable load on the arm. Currently this is commonly limited to a maximum of 0.5 kg vertical load.

The load limitation imposed by the single arm and single spring concept of the prior art places severe limitations on the motorized drapery system. In many instances motorized systems are used to eliminate the need for manual operation of large and heavy drapery systems. Weight limitations impose severe restrictions on the range of applications. Furthermore the maximum allowable weight due to the spring capacity can easily be exceeded, which would cause the load to lower the levered arm and free the connection between master carrier and drive belt. This would result in a malfunction of the motorized system when power is applied.

OBJECTS OF THE INVENTION

It is therefore an object of the invention to overcome at least some of the foregoing disadvantages of prior art systems.

It is a further object of the present invention to separate the vertical load capacity from the locking mechanism, so that the load capacity can be increased without diminishing the locking ability.

SUMMARY OF THE INVENTION

In accordance with one embodiment of the present invention, a disengageable master carrier assembly for a motor driven drapery is provided having a master carrier block section and a locking block section. The locking block section has entrance ramps and a detent or pocket that is sized to receive an engagement member mounted to the master carrier block section. The master carrier block assembly has:

a support arm for supporting a leading edge of drapery fabric, the support arm being supported by a first resilient member, the amount of resilient support for the support arm provided by the resilient member being changeable to adapt to drapery fabrics of different weights, such that the support arm will support the leading edge of drapery fabric and be held in an engaged operating position by the resilient support member when no manual force is applied to the leading edge of the fabric and will be displaced to a disengaged position when a manual force is applied to the leading edge of the fabric; and an engagement member sized for fitting into the detent pocket of the locking block member, the engagement member being resiliently urged by a second resilient member disposed between a movable portion of the support arm and a part of said engagement member.

The second resilient member has a resilience such that:

the engagement member will be urged into its engaged position in the detent pocket of the locking block section when the engagement member is aligned with the detent pocket and when the support arm is in its engaged position, displacement of the support arm to its disengaged position will cause the second resilient member to be sufficiently displaced to move the engagement member out of the detent pocket of the locking block section, to permit disengagement of locking block section from the master carrier block section, and direct force applied to the engagement member by the entrance ramps of the locking block section as the engagement member rides on the ramps during a re-engagement process will move the engagement member toward a disengaged position, against the urging force applied by the second resilient member, with the support arm in its engaged position.

BRIEF DESCRIPTION OF THE DRAWINGS

The foregoing and other objects, features and advantages will be apparent to those skilled in the art upon review of the detailed description herein, with reference to the drawings, in which.

DETAILED DESCRIPTION

Figure 1:
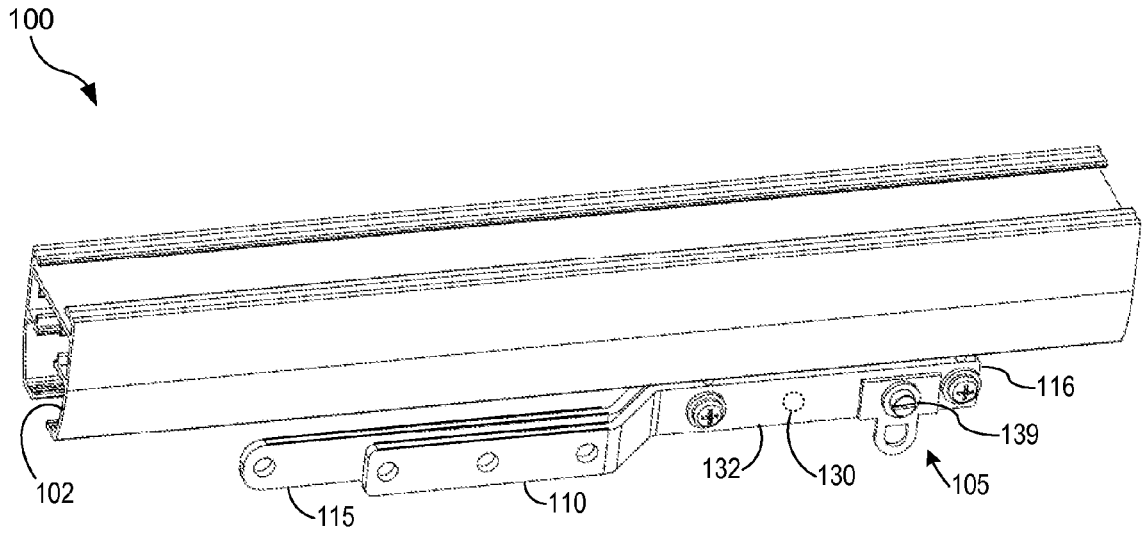
FIG. 1 depicts an orthogonal view, from the left side and above, of a disengageable master carriage assembly in accordance with an embodiment of the invention, mounted onto a drapery.
Figure 2:
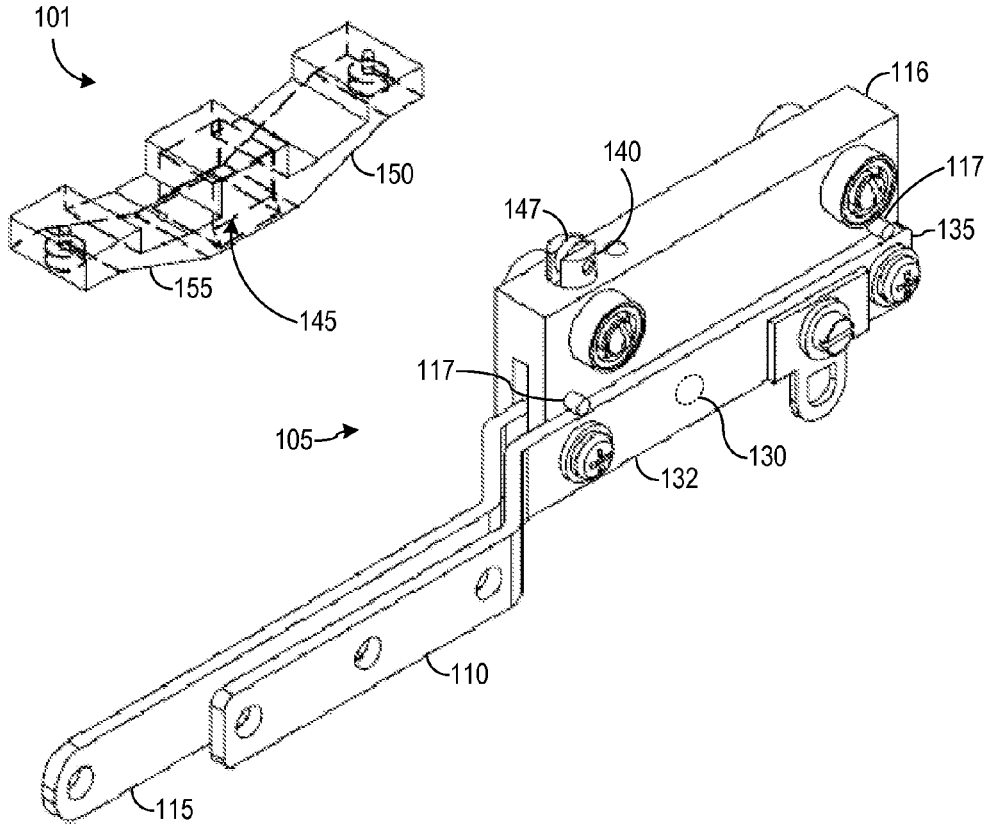
FIG. 2 depicts an orthogonal view, from the left side and above, of a disengageable master carrier assembly, with the locking block section separated from the master carrier block section.
Figure 3:
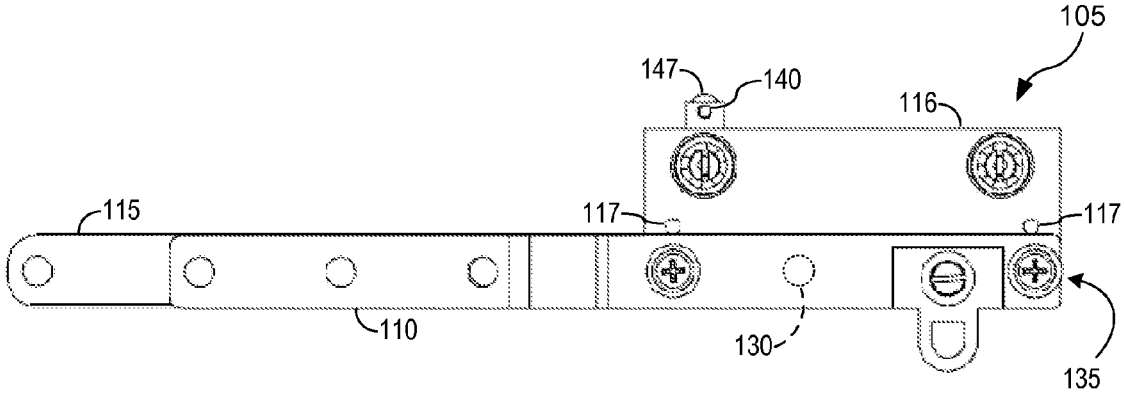
FIG. 3 depicts a front elevation view of the master carrier block.

Turning now to the drawings in detail, and initially to FIGS. 1, 2 and 3 thereof, one embodiment of a master carrier drive block assembly 100 in accordance with the invention is depicted. Master carrier block assembly 100, which can be slideably disposed inside headrail 102, is made up of two main components: the locking block section 101 that is connected to the drive belt (not shown) and the master carrier block section 105 that is attached to the forward end of the fabric of the drapes (not shown).

Turning now to FIGS. 4A-4C and 5A-5D, an elevation view of an embodiment of the master carrier block wherein the spring function required to carry the drapery load is separated from the spring function of the locking mechanism that disengageably connects the master carrier block 105 to the locking block section 101 connected to the drive belt (not shown) is depicted. In the embodiment depicted, the invention further uses dual metal arms 110 and 115 mounted to master carrier block body 116. One of these, shorter arm 110, can be mounted to the body 116 in a non-movable and non-spring-loaded manner to the master carrier block 105. This shorter arm 110 will carry all but the last inch or so of overlapping drapery weight. Because it need not be movable or spring-mounted, it is not subject to weight limitation, providing it is properly designed for the drapery load.

Figure 5C:
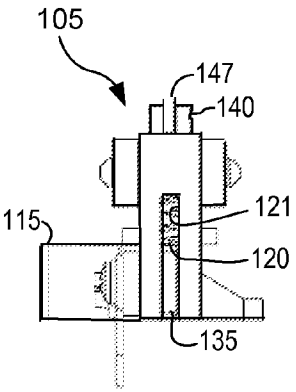
FIG. 5C depicts a rear end elevation view of the master carrier block, in the engaged condition.
Figure 5D:
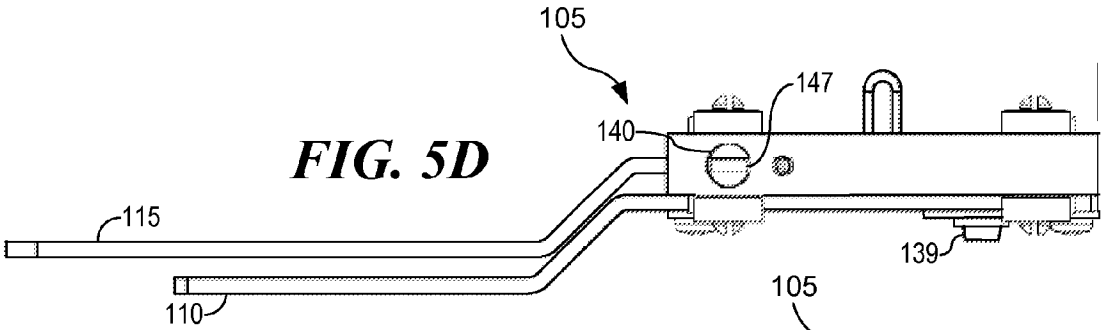
FIG. 5D depicts a plan view of the master carrier block, in the engaged condition.
Figure 5B:
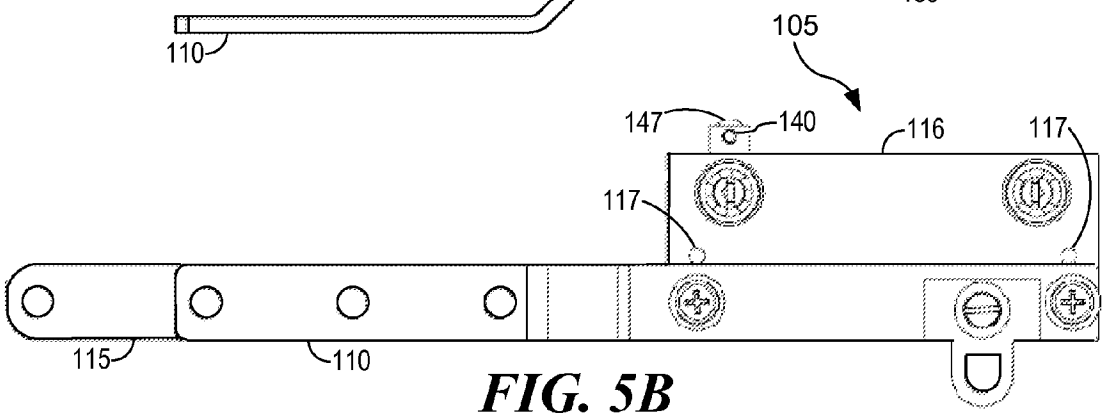
FIG. 5B depicts a front elevation view of the master carrier block, in the engaged condition.
Figure 5A:
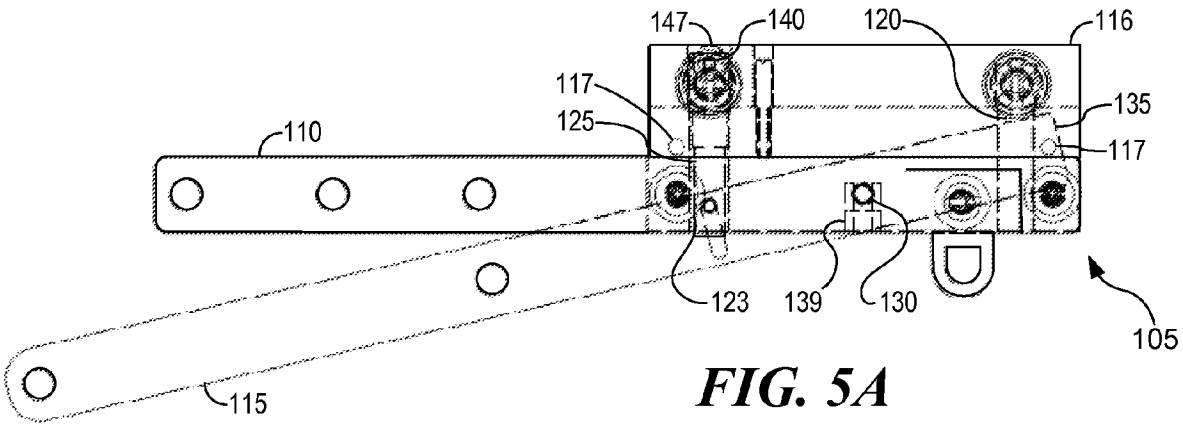
FIG. 5A depicts a front elevation view of the master carrier block assembly, partly in phantom, with the longer arm in the disengaged down condition caused by manually pulling the drapery front edge.

As can be seen in FIGS. 5A and 5D, unlike prior art systems, the engagement/disengagement function in the present invention is accomplished by using two separate springs 120 and 125 in master carrier block body 116. The longer arm 115 supports the leading edge of the drapery fabric (not shown). The longer arm 115 can protrude about one inch beyond the fixed shorter arm 110 and thus only has to support approximately the load of this last one-inch or so wide strip of fabric.

Longer arm 115 is pivoted about pivot 130 and held against the weight of the drapery fabric by a firm load-carrying spring 120 disposed in a cylinder 121 in the master carrier block, pressing upwardly on the rear end 135 of longer arm 115, behind the pivot 130 for the longer arm 115. Longer arm 115 could also be held in place by positioning spring 120 forward of the pivot 130, so it pressed upwardly on the bottom of the front 132 of longer arm 115. In the embodiment depicted, the longer arm 115 can be approximately parallel to the headrail 102, the position being determined by stops 117 on the master carrier block body 116, though a parallel position of the longer arm 115 is not mandatory.

The resilience of spring 120 can be adjustable by means of a set screw 139 for various vertical load carrying capacities. In this way, the disengaging force required can be adjusted depending on the weight of the drapery fabric selected. Furthermore different strength springs may be used to increase or decrease load capacity further if necessary for different draperies or headrail designed.

Figure 4A:
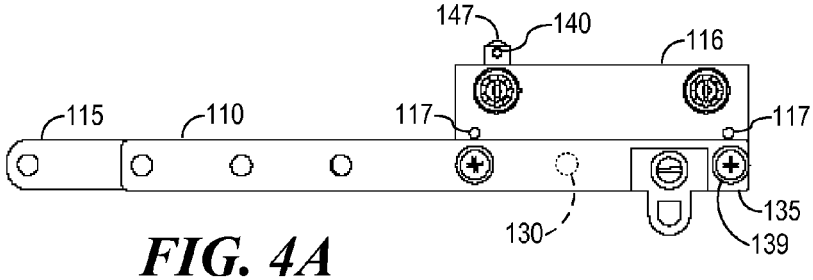
FIG. 4A depicts a front elevation view of the master carrier block, in the engaged condition.
Figure 6A:
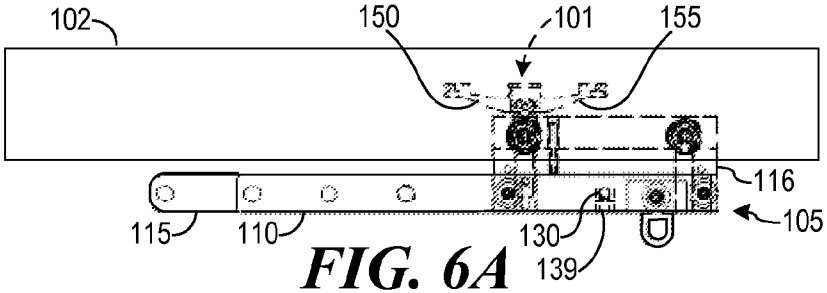
FIG. 6A depicts a front elevation view of the disengageable master carriage assembly, partly in phantom, mounted onto a headrail, in the normal operating engaged condition.

Referring to FIGS. 4A, 5B and 6A, the master carrier block assembly 100 is depicted with the longer arm 115 in its normal "up" position, with the pin 140 extended, as it would be with the locking block section 101 engaged. A locking pin 140 can hold the master carrier block 105 to the drapery drive belt locking block section 101 by extending into a pocket 145 in the middle locking block section. When engaged in this manner, this locking pin is normally held in place in the pocket by a separate, very light locking spring 125 positioned in pocket 145 in the master carrier block 105, squeezed upwardly against the bottom of the pin 140 by the rear 135 of pivoted longer arm 115 pressing on the bottom of the spring 125. Only light vertical force upward on the pin 140 from this light spring 125 is required to keep the pin 140 up and engaged in pocket 145.

Figure 4B:
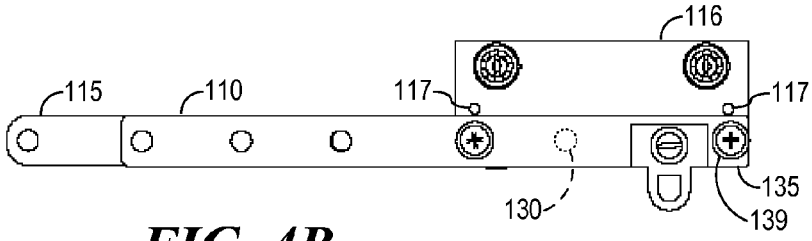
FIG. 4B depicts a front elevation view of the master carrier block, in the disengaged condition with the longer arm in the normal "up" condition, just prior to re-engagement into the locking block section.
Figure 4C:
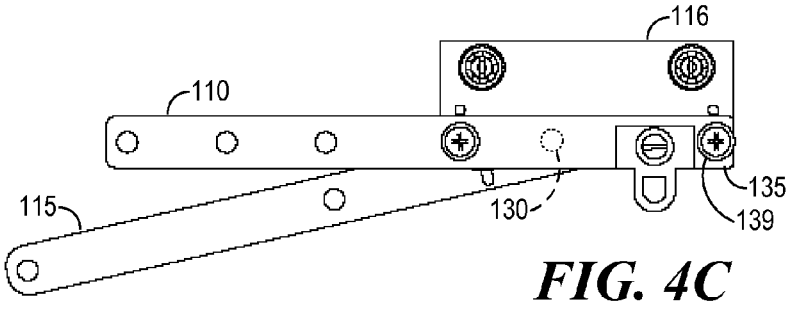
FIG. 4C depicts a front elevation view of the master carrier block, in the disengaged condition, with the longer arm in the disengaged down condition caused by manually pulling the drapery front edge.
Figure 6B:
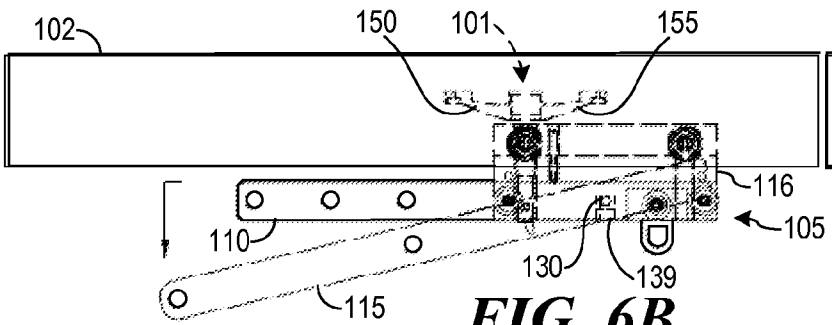
FIG. 6B depicts a front elevation view of the disengageable master carriage assembly, partly in phantom, mounted onto a headrail, with the longer arm in the disengaged down condition caused by manually pulling the drapery front edge, prior to separation of the locking block section.
Figure 6C:
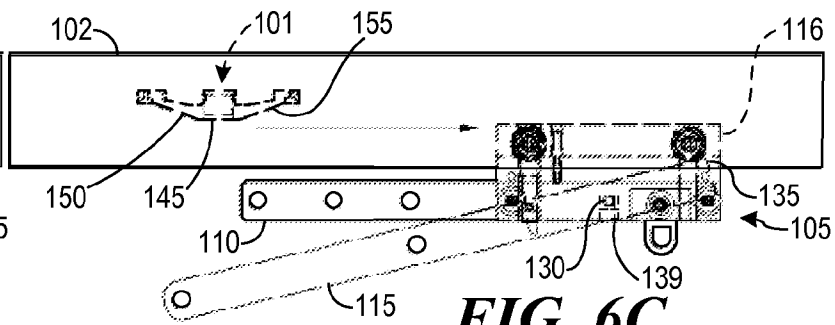
FIG. 6C depicts a front elevation view of the disengageable master carriage assembly, partly in phantom, mounted onto a headrail, with the longer arm in the disengaged down condition caused by manually pulling the drapery front edge, after separation of the locking block section.

As depicted in FIGS. 4C, 5A and 6B, a pull on the front of the drapery fabric by hand will cause the extended end of the longer arm 115 to pull down. This allows the light spring 125 on a pin 140 to relax and lower, thus lowering and disengaging the pin 140 from the pocket 145 of drapery belt locking block section 101. This instantaneously frees the connection between master carrier block 105 and the drive belt locking block section 101, thus permitting smooth manual opening or closing of the draperies without rotation of the drive belt or damage to the electric drive system, as depicted in FIG. 6C.

Figure 6D:
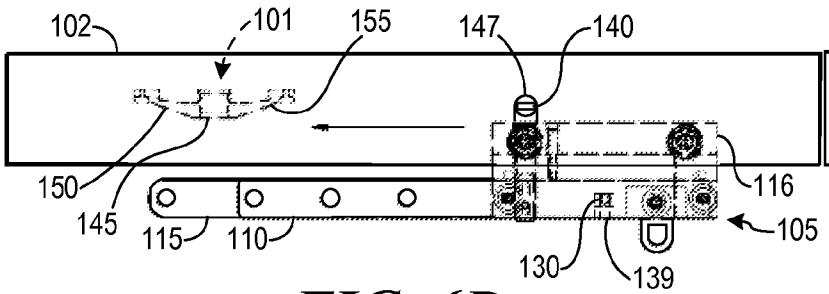
FIG. 6D depicts a front elevation view of the disengageable master carriage assembly, partly in phantom, mounted onto a headrail, with the longer arm in the up condition, prior to re-engagement of the locking block section.
Figure 6E:
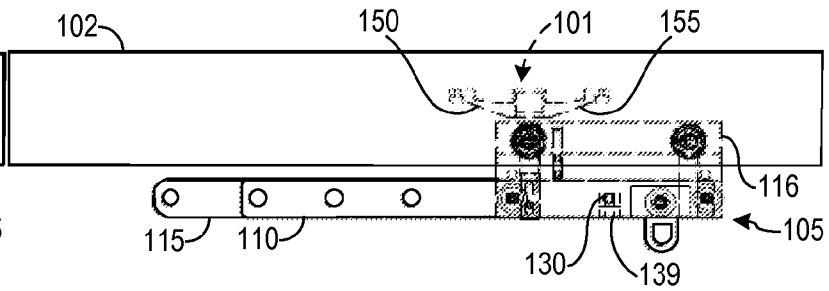
FIG. 6E depicts a front elevation view of the disengageable master carriage assembly, partly in phantom, mounted onto a headrail, with the longer arm in the up condition, prior to re-engagement of the locking block section.

As depicted in FIGS. 4B, 6D and 6E, when it is desired to return to motor driving of the draperies, activation of the drive motor will automatically guide the sloped forward (or back) entrance ramps 150 and 155 to the locking block section 101 toward the master carrier block. As depicted in FIGS. 4B and 6D, with the longer arm 115 in its normal "up" position (i.e., when the drapery is not being manually pulled) the light spring tension of the second light spring 125 can allow the pin 140 to retract into its cylinder 123, even while arm 115 is "up." Only light pressure on the top of pin 140 is required to push the pin 140 down to the disengaged position, with the longer arm 115 "up," as would be the case during the process of re-engagement of the locking block section. Then, as depicted in FIG. 6E, when pocket 145 aligns with pin 140, the spring 125 will extend the pin 140 into the pocket 145, reestablishing the positive traction of the electric motor drive.

As depicted in FIGS. 1, 2 and 3, for example, the locking pin 140 can be provided with a rotatable wheel 147 at its anterior end that can ride up the sloped surfaces of the entrance ramps 150 and/or 155 of the locking block section 101 attached to the belt (not shown). Rotatable wheel 147 will ensure extremely smooth return of the pin 140 into the pocket 145 of the locking block section 101 to reconnect the master carrier block 105 to the locking block section 101.

The pre-set end stops of the electric drive system are not affected by the manual operation because the position is determined by the rotation of the drive belt. This ensures ongoing accurate opening and stacking position of the draperies and maintaining of the final preset desired drapery end position. These end position may be preset and controlled by Silent Stop™ (a trademark for a BTX, Inc. product for controlling the drapery stopping position of an electric motor driven drapery) or by other means.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It is therefore contemplated that the claims will cover any such modifications or embodiments that fall within the true scope and spirit of the invention.

What is claimed is:

1. A disengageable master carrier assembly for a motor driven drapery, comprising:

a master carrier block section and a locking block section;

the locking block section having a detent pocket sized to receive an engagement member mounted to the master carrier block section;

the master carrier assembly having:

a support arm for supporting a leading edge of drapery fabric, the support arm being supported by a first resilient member, the amount of resilient support for the support arm provided by the resilient member being changeable to adapt to drapery fabrics of different weights, such that the support arm will support a generally forward portion of drapery fabric and be held in an engaged operating position by the resilient support member when no manual force is applied to the leading edge of the fabric and will be displaced to a disengaged position when a manual force is applied to the leading edge of the fabric;

an engagement member sized for fitting into the detent pocket of the locking block section, the engagement member being resiliently urged by a second resilient member disposed between a movable portion of the support arm and a part of said engagement member;

the second resilient member having a resilience such that:

the engagement member will be urged into its engaged position in the detent pocket of the locking block section, when the engagement member is aligned with the detent pocket and when the support arm is in its engaged position, displacement of the support arm to its disengaged position will cause the second resilient member to be sufficiently displaced to move the engagement member out of the detent pocket of the locking block section, to permit disengagement of locking block section from the master carrier block section, and with the support arm in its engaged position, direct force applied to the engagement member by the locking block section as the engagement member is moved onto the locking block section during a re-engagement process being sufficient to move the engagement member toward a disengaged position, against the urging force applied by the second resilient member, the resilience of the second resilient member being sufficient to re-engage the engagement member with the detent pocket when the engagement member is realigned with the detent pocket; and wherein the support arm is a first support arm and the master carrier block section further comprises a second support arm fixedly mounted to the master carrier block section for supporting at least a portion of the weight of a generally forward portion of the drapery fabric.

2. A disengageable master carrier assembly for a motor driven drapery, comprising:

a master carrier block section and a locking block section;

the locking block section having a detent pocket sized to receive an engagement member mounted to the master carrier block section;

the master carrier assembly having:

a support arm for supporting a leading edge of drapery fabric, the support arm being supported by a first resilient member, the amount of resilient support for the support arm provided by the resilient member being changeable to adapt to drapery fabrics of different weights, such that the support arm will support a generally forward portion of drapery fabric and be held in an engaged operating position by the resilient support member when no manual force is applied to the leading edge of the fabric and will be displaced to a disengaged position when a manual force is applied to the leading edge of the fabric;

an engagement member sized for fitting into the detent pocket of the locking block section, the engagement member being resiliently urged by a second resilient member disposed between a movable portion of the support arm and a part of said engagement member;

the second resilient member having a resilience such that:

the engagement member will be urged into its engaged position in the detent pocket of the locking block section, when the engagement member is aligned with the detent pocket and when the support arm is in its engaged position, displacement of the support arm to its disengaged position will cause the second resilient member to be sufficiently displaced to move the engagement member out of the detent pocket of the locking block section, to permit disengagement of locking block section from the master carrier block section, and with the support arm in its engaged position, direct force applied to the engagement member by the locking block section as the engagement member is moved onto the locking block section during a re-engagement process being sufficient to move the engagement member toward a disengaged position, against the urging force applied by the second resilient member, the resilience of the second resilient member being sufficient to re-engage the engagement member with the detent pocket when the engagement member is realigned with the detent pocket;

wherein the support arm is a first support arm and the master carrier block section further comprises a second support arm fixedly mounted to the master carrier block section for supporting at least a portion of the weight of a generally forward portion of the drapery fabric; and wherein the first support arm extends farther than the second support arm and supports as least the leading edge of the drapery fabric.

3. A disengageable master carrier assembly for a motor driven drapery, comprising:

a master carrier block section and a locking block section;

the locking block section having a detent pocket sized to receive an engagement member mounted to the master carrier block section;

the master carrier assembly having:

a support arm for supporting a leading edge of drapery fabric, the support arm being supported by a first resilient member, the amount of resilient support for the support arm provided by the resilient member being changeable to adapt to drapery fabrics of different weights, such that the support arm will support a generally forward portion of drapery fabric and be held in an engaged operating position by the resilient support member when no manual force is applied to the leading edge of the fabric and will be displaced to a disengaged position when a manual force is applied to the leading edge of the fabric;

an engagement member sized for fitting into the detent pocket of the locking block section, the engagement member being resiliently urged by a second resilient member disposed between a movable portion of the support arm and a part of said engagement member;

the second resilient member having a resilience such that:

the engagement member will be urged into its engaged position in the detent pocket of the locking block section, when the engagement member is aligned with the detent pocket and when the support arm is in its engaged position, displacement of the support arm to its disengaged position will cause the second resilient member to be sufficiently displaced to move the engagement member out of the detent pocket of the locking block section, to permit disengagement of locking block section from the master carrier block section, and with the support arm in its engaged position, direct force applied to the engagement member by the locking block section as the engagement member is moved onto the locking block section during a re-engagement process being sufficient to move the engagement member toward a disengaged position, against the urging force applied by the second resilient member, the resilience of the second resilient member being sufficient to re-engage the engagement member with the detent pocket when the engagement member is realigned with the detent pocket;

wherein the locking block section includes at least one ramp adapted to permit the engagement member to ride against it, such that riding up the ramp causes the engagement member to be moved against the force of the second resilient member toward a disengaged position; and wherein the engagement member includes a wheel to facilitate riding onto the ramp.

4. A disengageable master carrier assembly for a motor driven drapery, comprising:

a master carrier block section and a locking block section;

the locking block section having a detent pocket sized to receive an engagement member mounted to the master carrier block section;

the master carrier assembly having:

a support arm for supporting a leading edge of drapery fabric, the support arm being supported by a first resilient member, the amount of resilient support for the support arm provided by the resilient member being changeable to adapt to drapery fabrics of different weights, such that the support arm will support a generally forward portion of drapery fabric and be held in an engaged operating position by the resilient support member when no manual force is applied to the leading edge of the fabric and will be displaced to a disengaged position when a manual force is applied to the leading edge of the fabric;

an engagement member sized for fitting into the detent pocket of the locking block section, the engagement member being resiliently urged by a second resilient member disposed between a movable portion of the support arm and a part of said engagement member;

the second resilient member having a resilience such that:

the engagement member will be urged into its engaged position in the detent pocket of the locking block section, when the engagement member is aligned with the detent pocket and when the support arm is in its engaged position, displacement of the support arm to its disengaged position will cause the second resilient member to be sufficiently displaced to move the engagement member out of the detent pocket of the locking block section, to permit disengagement of locking block section from the master carrier block section, and with the support arm in its engaged position, direct force applied to the engagement member by the locking block section as the engagement member is moved onto the locking block section during a re-engagement process being sufficient to move the engagement member toward a disengaged position, against the urging force applied by the second resilient member, the resilience of the second resilient member being sufficient to re-engage the engagement member with the detent pocket when the engagement member is realigned with the detent pocket;

wherein the locking block section includes at least one ramp adapted to permit the engagement member to ride against it, such that riding up the ramp causes the engagement member to be moved against the force of the second resilient member toward a disengaged position;

wherein the engagement member includes a wheel to facilitate riding onto the ramp; and wherein the locking block section includes forward and aft ramps.

* * * * *